US012384432B2

(12) United States Patent
Fernandes et al.

(10) Patent No.: US 12,384,432 B2
(45) Date of Patent: Aug. 12, 2025

(54) END OF TRAIN (EOT) REMOTE TRACK-CONDITION MONITORING

(71) Applicant: Siemens Mobility, Inc., New York, NY (US)

(72) Inventors: Mario Fernandes, Jacksonville, FL (US); Omer Metel, Anchorage, KY (US); Gary Parkinson, Bournemouth (GB)

(73) Assignee: Siemens Mobility, Inc., New York, NY (US)

( * ) Notice: Subject to any disclaimer, the term of this patent is extended or adjusted under 35 U.S.C. 154(b) by 688 days.

(21) Appl. No.: 16/973,811

(22) PCT Filed: Jun. 12, 2018

(86) PCT No.: PCT/US2018/037041

§ 371 (c)(1),
(2) Date: Dec. 10, 2020

(87) PCT Pub. No.: WO2019/240767

PCT Pub. Date: Dec. 19, 2019

(65) Prior Publication Data

US 2021/0261176 A1 Aug. 26, 2021

(51) Int. Cl.

| | |
|---|---|
| ***B61L 15/00*** | (2006.01) |
| ***B61L 23/04*** | (2006.01) |
| ***B61L 25/02*** | (2006.01) |

(52) U.S. Cl.
CPC ..... *B61L 15/0054* (2013.01); *B61L 23/042* (2013.01); *B61L 25/025* (2013.01)

(58) Field of Classification Search
CPC .. B61L 15/00; B61L 15/0018; B61L 15/0054; B61L 15/0081; B61L 23/042;
(Continued)

(56) References Cited

U.S. PATENT DOCUMENTS 5,433,111 A * 7/1995 Hershey ..... B61L 25/025 246/169 R
5,532,677 A * 7/1996 Miller ..... A63B 71/0622 473/150

(Continued)

FOREIGN PATENT DOCUMENTS

KR 20140074312 A * 6/2014
WO 2005105536 A1 10/2005

OTHER PUBLICATIONS

PCT International Search Report and Written Opinion of International Searching Authority mailed Feb. 11, 2019 corresponding to PCT International Application No. PCT/US2018/037041 filed Jun. 12, 2018.

*Primary Examiner* — S. Joseph Morano
*Assistant Examiner* — Cheng Lin

(57) ABSTRACT

An end of train device (100) suitable of use on a railway vehicle includes an enclosure (110), one or more accelerometers (180) positioned inside the enclosure (110) and providing accelerometer data of a railway vehicle (230) when travelling on a railway track (240), and a tracking device (185) positioned inside the enclosure (110) and providing location data, wherein the accelerometer data and location data are analyzed to determine a condition of the railway track (240). Further, a track monitoring system (200) and a method (300) for continuous monitoring of railway tracks (240) are provided.

7 Claims, 2 Drawing Sheets

(58) Field of Classification Search
CPC ..... B61L 25/00; B61L 25/02; B61L 25/025; B61L 25/06; B61L 2205/04
See application file for complete search history.

(56) References Cited

U.S. PATENT DOCUMENTS

| | | | | |
|---|---|---|---|---|
| 5,579,013 | A * | 11/1996 | Hershey | G01S 5/0027 342/357.4 |
| 6,668,239 | B1 * | 12/2003 | Gilbert | B61L 23/047 702/34 |
| 2006/0192974 | A1 * | 8/2006 | Li | G01D 5/268 73/514.27 |
| 2009/0177344 | A1 * | 7/2009 | James | B61L 27/20 701/19 |
| 2010/0213321 | A1 * | 8/2010 | Kane | B61L 25/025 246/167 R |
| 2014/0277824 | A1 * | 9/2014 | Kernwein | B61K 9/08 701/1 |
| 2015/0051792 | A1 * | 2/2015 | Kristen | B61K 9/12 701/34.2 |
| 2017/0253258 | A1 * | 9/2017 | Bramucci | B61L 15/0054 |
| 2018/0327010 | A1 * | 11/2018 | Kernwein | B61L 1/14 |

* cited by examiner

END OF TRAIN (EOT) REMOTE TRACK-CONDITION MONITORING

BACKGROUND

1. Field

Aspects of the present disclosure generally relate to remote track-condition monitoring, specifically remote track-condition monitoring utilizing an end of train device.

2. Description of the Related Art

Railway is one of the most used means of transportation. For the railway system to operate flawlessly constant monitoring and inspection of railway tracks is required to prevent or correct track defects. Currently railway track inspection and monitoring are usually performed by sporadic deployment of specialized track inspection equipment, or by visual inspection, performed manually, which is time consuming and may not be accurate due to human error occurrence. Moreover, practically it is impossible to inspect and monitor railway tracks manually as they run thousands of miles. Another possibility is the use of locomotive-based equipment, such as specially designed camera systems.

Within the railway industry, an end of train device, herein also referred to as EOT, is an electronic device which can perform a number of functions, some of which are required by regulations of the Federal Railroad Administration (FRA). The EOT is typically attached at a rear of a last car on a railway vehicle or train, often to an unused coupling on an end of the last car opposite the head of the train.

EOTs were originally designed to perform some of the functions previously performed by train personnel located in the caboose, thereby allowing trains to operate without a caboose and with a reduced number of train personnel. For example, an EOT can monitor air pressure in the air brake pipe and transmit this information to a head of train device (HOT). Further, EOTs also often include an end-of-train marker light to alert trailing trains on the same track of the presence of the end of the train. Two-way EOTs can accept commands from the HOT, for example to open a valve to release pressure in the air brake pipe so that the train's air brakes activate to stop the train in an emergency. EOTs can comprise many other components and/or functions.

SUMMARY

Briefly described, aspects of the present disclosure relate to remote track-condition monitoring utilizing an end of train device (EOT). The EOT is suitable for railway vehicles such as freight trains and passenger trains.

A first aspect of the present disclosure provides an end of train device suitable of use on a railway vehicle comprising an enclosure, at least one accelerometer positioned inside the enclosure and providing accelerometer data of a railway vehicle when travelling on a railway track, and a tracking device positioned inside the enclosure and providing location data, wherein the accelerometer data and location data are analyzed to determine a condition of the railway track.

A second aspect of the present disclosure provides a track monitoring system comprising an end of train device, a central computer system, a communication network interfacing with the end of train device and the central computer system and adapted to transmit data, wherein the end of train device collects accelerometer data and location data of a railway vehicle when travelling on railway tracks, and wherein collected accelerometer data and location data are transmitted to the central computer system via the communication network.

A third aspect of the present disclosure provides a method for continuous monitoring of railway tracks comprising: collecting accelerometer data and location data by an end of train device, transmitting collected data to a central computer system via a communication network, and analyzing the collected data for markers that indicate railway track defects.

DETAILED DESCRIPTION

To facilitate an understanding of embodiments, principles, and features of the present invention, they are explained hereinafter with reference to implementation in illustrative embodiments. In particular, they are described in the context of an end of train device (EOT) for a railway vehicle, a track monitoring system and a method for continuous monitoring of railway tracks. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
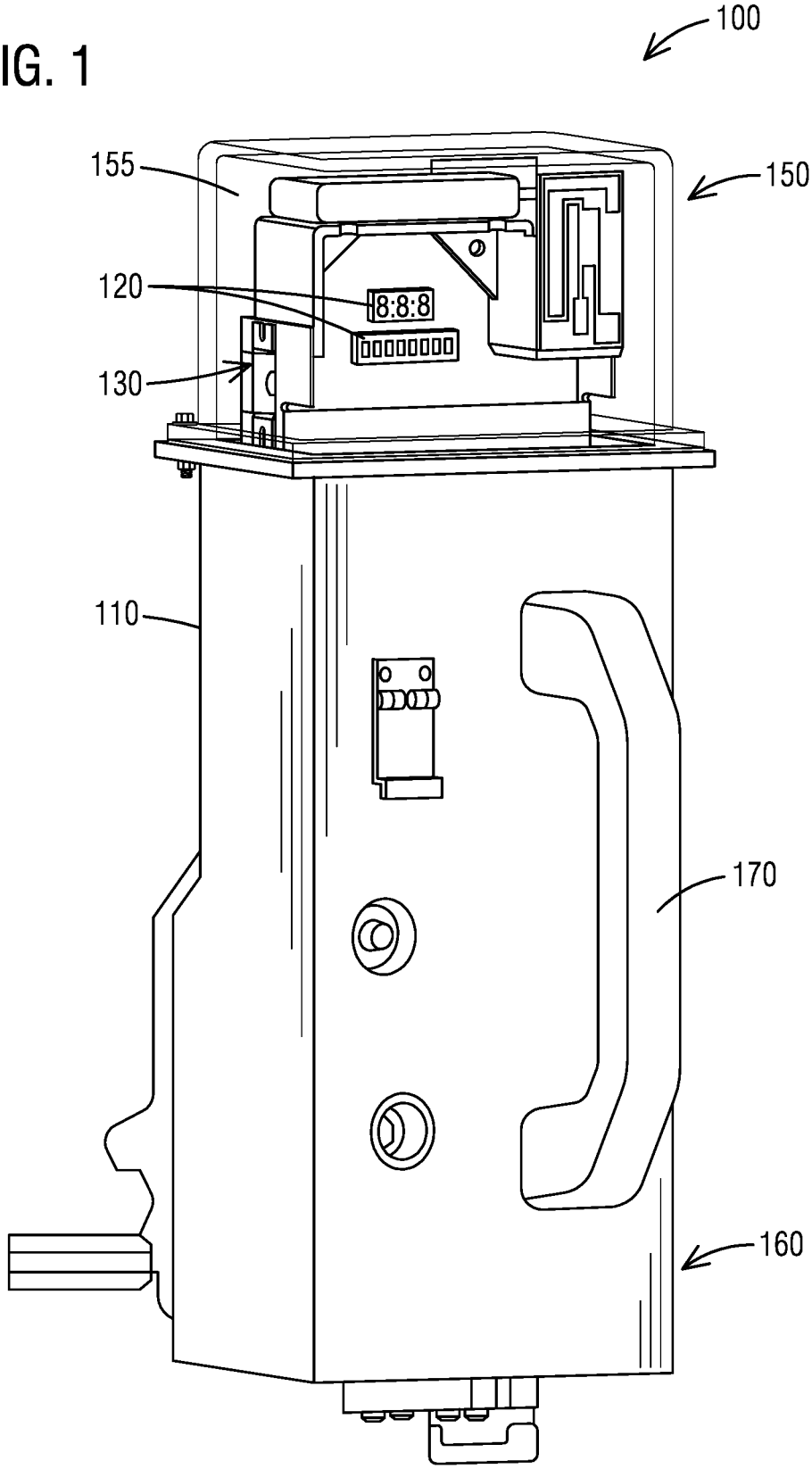
FIG. 1 illustrates a perspective view of an end of train device in accordance with an exemplary embodiment of the present disclosure.

FIG. 1 illustrates a view of an EOT 100 in accordance with an exemplary embodiment of the present disclosure. The EOT 100 is suitable of use on a railway vehicle located on a last train car of the railway vehicle, for example a freight train. The EOT 100 comprises an enclosure 110, and a plurality of components, such as electronic components, positioned inside the enclosure 110. For example, one or more displays 120 are positioned inside the enclosure 110. The one or more displays 120 display information and/or data provided by the EOT 100. An important component of the EOT 100 is a high visibility marker light (HVM) 130 which is utilized to illuminate a rearward of the railway vehicle. The EOT 100 further comprises a coupling unit (not visible in FIG. 1), typically attached to the housing 110, which couples the EOT 100 to the last train car, for example a train car coupling.

Examples of other components of the EOT 100 include cell phone transceivers, systems for monitoring/controlling brake lines and pressure, communication systems for communicating with other units such as for example head of train devices etc. It should be noted that one of ordinary skill in the art is familiar with structure, components and functions of different types of EOTs, and they will not be described in further detail herein.

In an exemplary embodiment, the enclosure 110 comprises a top portion 150 and a bottom portion 160. The top portion 150 comprises a transparent dome 155. The transparent dome 155 is configured such that information displayed by the displays 120 as well as the HVM 130 are visible from an outside of the enclosure 110 through the transparent dome 155 of the top portion 150. The bottom portion 160 can be opaque or also transparent. The top portion 150 comprising the transparent dome 155 is formed from transparent material, for example molded from transparent material. The transparent material comprises clear plastic material, such as for example polycarbonate. Polycarbonate is available in grades that are clear and that have UV resistance, and it is a strong material that is suitable for use in an industrial enclosure. The top portion 150 can be a monolithic component. In other words, the top portion 150 including the transparent dome 155 can be a one-piece component formed or molded from transparent material thereby providing a single part as the top portion 150. The bottom portion 160 can be formed, for example molded, from plastic material, but would typically not comprise transparent plastic material, but opaque plastic material.

The EOT 100 further comprises a handle 170 attached to the housing 110 for handling such as installation and removal of the EOT 100 on/off a train car of a railway vehicle, in particular a last train car.

As described before, railway is one of the most used means of transportation. For the railway system to operate flawlessly constant monitoring and inspection of railway tracks is required to prevent or correct track defects. In an exemplary embodiment of the present disclosure, the EOT 100 is configured such that a continuous monitoring of railway tracks may be performed remotely utilizing the EOT 100. Specifically, the EOT 100 is adapted or configured to determine and/or measure and record a motion of a railway vehicle across one or more axes (x-, y-, z-axis in the three-dimensional Cartesian coordinate system) as the railway vehicle moves along the railway track, wherein for example vibration, shock, altitude and geographic position information are continuously monitored and captured. Information collected by the EOT 100 is then statistically analyzed for markers that indicate potential track defects. The EOT 100 as a component of a track monitoring system will be described in more detail with reference to FIG. 2.

Figure 2:
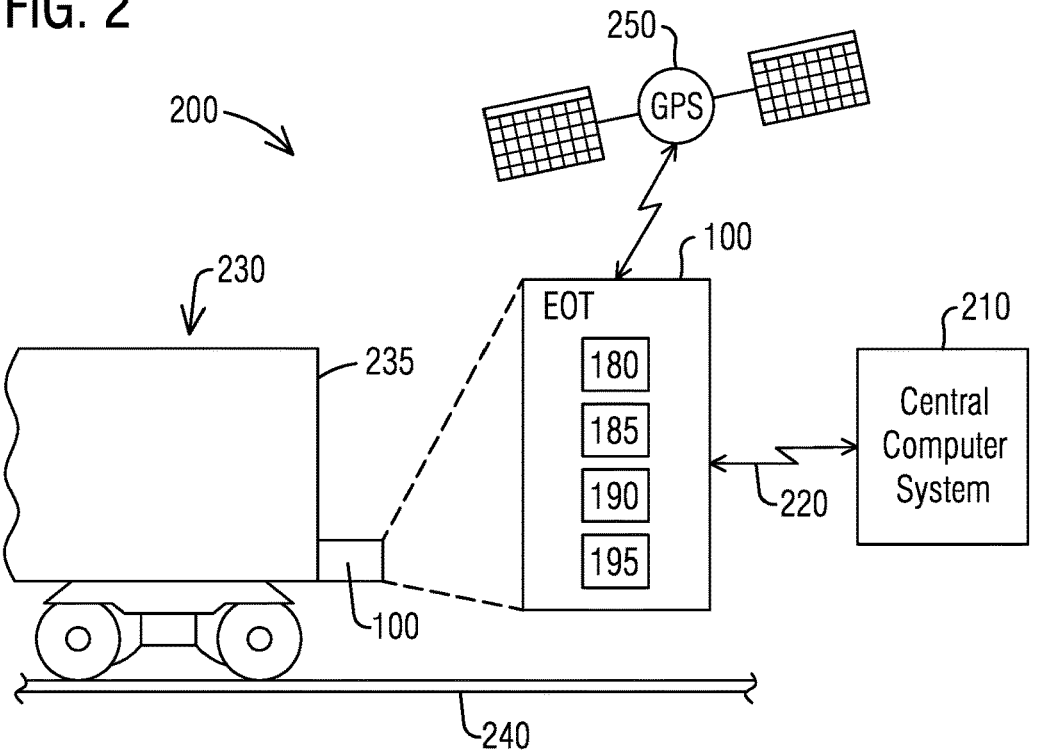
FIG. 2 illustrates schematically a track monitoring system in accordance with an exemplary embodiment of the present disclosure.

FIG. 2 illustrates a schematic of a track monitoring system 200 in accordance with an exemplary embodiment of the present disclosure. The track monitoring system 200 comprises EOT 100, a central computer system 210 and a communication network 220 interfacing with the EOT 100 and the central computer system 210 and adapted to transmit data.

The EOT 100 is attached at a rear of a last car 235 on a railway vehicle/train 230 travelling on railway track 240, for example to an unused coupling on an end of the last car opposite the head of the train 230.

In accordance with an exemplary embodiment, the EOT 100 comprises at least one accelerometer 180, the accelerometer providing accelerometer data, specifically accelerometer vibration data, of the railway vehicle 230 when travelling on the railway track 240, and a tracking device 185 providing location data. The at least one accelerometer 180 and tracking device 185 are positioned inside the enclosure 110, for example in the bottom portion 160, of the EOT 100 (see FIG. 1)

Generally, the accelerometer vibration data and the location data are utilized for a continuous monitoring of railway track conditions. The EOT 100, when coupled to the railway vehicle 230 and travelling on railway track 240, determines and/or measures a motion of the railway vehicle 230 across one or more axes (x-, y-, z-axis of the Cartesian coordinate system), wherein for example vibration, shock, altitude and geographic position information are continuously monitored and captured utilizing the at least one accelerometer 180 and the tracking device 185. Information captured and collected by the EOT 100 is then statistically analyzed to determine the conditions of the railway tracks, for example is analyzed for markers that indicate potential track defects. It should be noted that the EOT 100 can comprise one or more accelerometers 180, depending on for example a capacity of an accelerometer or specific requirements of the EOT 100. The one or more accelerometers 180 can be configured as accelerometer sensor card(s).

The at least one accelerometer 180 measures and captures a motion of the railway vehicle 230 across three axes, the x-, y-, and z-axis in a three-dimensional space (3-axis-accelerometer). To detect and differentiate between types of vibration and shock, the at least one accelerometer 180 comprises a high-resolution accelerometer, and can detect and process low-frequency vibrations. Using a high-resolution, low-frequency accelerometer 180, the EOT 100 can detect for example track voids under both switchings and crossings and plain track, dip track on both plain track and switchings and crossings, and rough ride of the railway vehicle. Track voids occur where track support conditions have been deteriorated over time. This could be due to drainage issues, gaps between the ballast and sleeper or poor maintenance. Track voids cause substantial delay minutes, can lead to line closures and can increase the chance of derailment. Dip track occurs where voids underneath the track cause the track to buckle from the lack of support. Rough ride occurs when the train moves over a track defect, causing the train to bounce or sway leading to an uncomfortable ride for passengers. Further, wheel flat spots of the railway vehicle can be detected allowing maintenance teams to repair or replace a wheel before it becomes an issue.

The tracking device 185 comprises a receiver for a satellite navigation system 250, for example a global positioning system (GPS) receiver. Alternatively, the tracking device 185 may comprise a Galileo satellite navigation system receiver.

The EOT 100 further comprises a memory module 195 for storing monitored and captured accelerometer data and location data. The accelerometer data and/or location data are stored as raw data or as pre-processed data in the memory module 195. The data can be pre-processed by the EOT 100, wherein the pre-processed data can comprise frequency-domain data.

The EOT 100 further comprises a communication module 190 for transmitting captured and collected accelerometer data and location data to the central computer system 210. Data are transmitted as raw data or pre-processed data. The central computer system 210 is for example a remote central computer system or a remote central server. Such a remote system or server can be located for example at a central train operator station or a rail operations center.

A communication network 220, adapted to transmit data, is interfacing with the EOT 100 and the central computer system 210. The communication network 220 comprises a wireless communication network, which can be a network such as for example the Internet or many other network environments that are accessible via an air interface, e.g. Wi-Fi.

The central computer system 210 is adapted to analyze the accelerometer data including defect signals for markers that indicate potential railway track defects. The location data ensure that maintenance is accurately directed and planned, minimizing the time maintenance staff spend on track and therefore improving their safety.

As noted before, vibration, shock, altitude of the railway vehicle when travelling on railway tracks are continuously monitored and captured by the at least one accelerometer 180. A defect type of the railway track 240, such as track voids, rough-ride or dip track are defined based on the measured vibration and shock. In an embodiment, the EOT 100 is configured to define the defect type of the railway track. The tracking device 185 and its location functionality is used to provide an accurate defect location. In this case, pre-processed (vibration) data, for example a defect signal corresponding to the defined defect type, and the location data of the defect signal are communicated to the central computer system 210. In another embodiment, the EOT 100 transmits raw data to the central computer system 210, wherein the central computer system 210 determines the defect type. The defect type can be determined for example by comparing collected accelerometer vibration data to previously stored data characterizing a specific track defect.

Further, in another embodiment, the track monitoring system 200 can be configured to identify different severity of detected defects. A Red/Amber/Green severity level may be provided wherein Red is more urgent so that track repair resources can be directed towards the more urgent items first. In an example, the central computer system 210 is configured to provide such a severity level.

When EOTs 100 are installed in almost all trains or railway vehicles travelling within the railway network, the disclosed EOT 100, system 200 and method 300 provide network-wide track condition monitoring. Multiple trains monitoring the same tracks leads to a reduction in false alarms and increased accuracy of defect type and location. Planned and directed maintenance minimizes time maintenance staff spend on tracks, thereby improving maintenance workers' safety. Further, preventive maintenance is provided, where a comparison between runs can highlight sections where track deterioration is detected. This allows the maintenance teams to correct the problems before it becomes a more serious defect.

Figure 3:
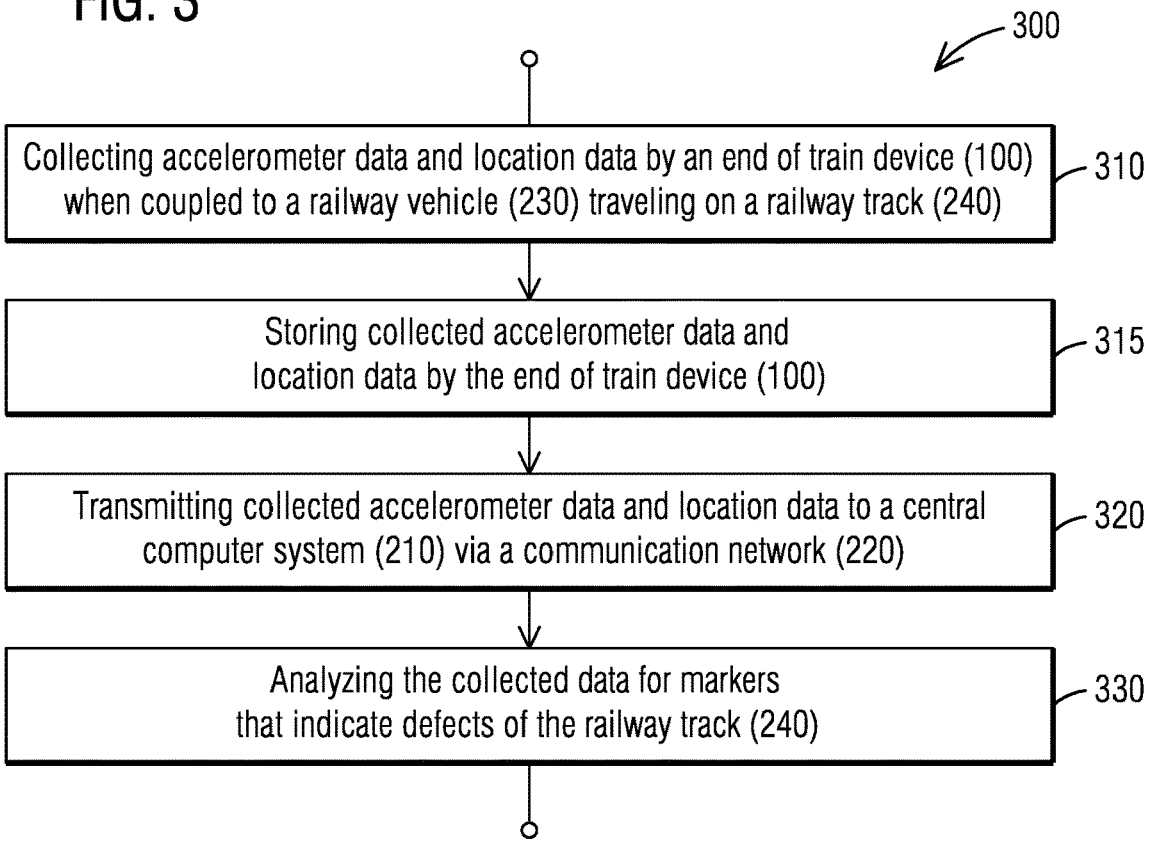
FIG. 3 illustrates a flow chart of a method for continuous monitoring of railway track conditions in accordance with an exemplary embodiment of the present disclosure.

FIG. 3 illustrates a flow chart of a method 300 for continuous monitoring of railway track conditions in accordance with an exemplary embodiment of the present disclosure. The method 300 refers to the components and elements as described before with reference to FIG. 1 and FIG. 2.

Summarizing, in a first step 310, accelerometer vibration data and location data are collected by the EOT 100 when coupled to the railway vehicle 230 travelling on the railway track 240. Collected accelerometer data and location data are stored by the EOT 100 (step 315). After data and information has been collected by the EOT 100, the data and information are periodically transmitted wirelessly to the central computer system 210 by communication network 220 (step 330). The data and information can be directly or indirectly transmitted to the central computer system 210. For example, the data/information may be transmitted to an intermediate (in-between) device, for example a control unit installed close to the railway track 240, such as for example a grade crossing predictor (GCP), wherein collected data from multiple railway vehicles or trains 230 are collected by the intermediate device and are then transmitted to the central computer system 210 for further processing and analyzing. The collected data are analyzed for markers that indicate defects of the railway track 240. The collected accelerometer data may be pre-processed by the EOT 100 before transmitting to the central computer system 210 or an intermediate device. It should be appreciated that the described method 300 can comprise more steps, or some steps can be repeated multiple times, or some steps are optional. For example, pre-processing of the accelerometer data by the EOT 100 is optional. Transmitting 320 of data can be repeated multiple times before data analyzing 330.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

The invention claimed is:

1. An end of train device for a railway vehicle comprising:

an enclosure, at least one accelerometer positioned inside the enclosure and providing accelerometer vibration data of a railway vehicle when travelling on a railway track, a tracking device positioned inside the enclosure and providing location data, and a communication module integrated into the end of train device and configured to transmit the accelerometer vibration data and location data directly to a central computer system via a wireless communication network interfacing with the end of train device, the central computer system being a remote central computer system located at a central train operator station or a rail operations center, a memory module for storing the accelerometer vibration data and location data, wherein the accelerometer vibration data and location data are stored as pre-processed data in the memory module, wherein the pre-processed data comprise accelerometer frequency-domain data, wherein the accelerometer vibration data and location data are analyzed to determine a condition of the railway track, and wherein the at least one accelerometer is configured to measure and capture a motion of the railway vehicle across three axes in a three-dimensional space to detect types of vibration and shock and conditions including track voids and dip track.

2. The end of train device of claim 1, wherein the at least one accelerometer comprises a high-resolution accelerometer.

3. The end of train device of claim 1, wherein the tracking device comprises a global positioning system (GPS) receiver.

4. The end of train device of claim 1, further comprising:

a top portion and a bottom portion, wherein the top portion comprises a transparent dome formed from transparent material.

5. A railway vehicle comprising an end of train device as claimed in claim 1.

6. A method for continuous monitoring of railway tracks comprising:

collecting accelerometer vibration data and location data by an end of train device when coupled to a railway vehicle travelling on a railway track, wherein the end of train device comprises at least one accelerometer configured to measure and capture a motion of the railway vehicle across three axes in a three-dimensional space to detect between types of vibration and shock and conditions including track voids and dip track, storing collected accelerometer vibration data and location data by the end of train device, pre-processing the collected accelerometer vibration data by the end of train device before transmitting to the central computer system, pre-processed accelerometer vibration data and location data comprising accelerometer frequency-domain data, transmitting, by a communication module integrated in the end of train device, collected accelerometer vibration data and location data directly to a remote central computer system via a wireless communication network interfacing with the end of train device and the remote central computer system, the remote central computer system being located at a central train operator station or a rail operations center, and analyzing the collected data for markers that indicate defects of the railway track.

7. The method of claim 6, further comprising:

defining a defect type of the railway track based on the accelerometer vibration data.

* * * * *